US006418988B1

(12) United States Patent
Palumbo et al.

(10) Patent No.: US 6,418,988 B1
(45) Date of Patent: Jul. 16, 2002

(54) HANDS-FREE REFUELING TRIGGER STANCHION

(76) Inventors: James Joseph Palumbo, 108 Beeston Ct., Morrisville, NC (US) 27560; Robert James Snyder, 5805 Hedgemoor Dr., Raleigh, NC (US) 27612

( * ) Notice: Subject to any disclaimer, the term of this patent is extended or adjusted under 35 U.S.C. 154(b) by 0 days.

(21) Appl. No.: 09/682,932

(22) Filed: Nov. 1, 2001

(51) Int. Cl.[7] ..... B65B 1/04
(52) U.S. Cl. ..... 141/392; 251/90
(58) Field of Search ..... 141/392; 251/90, 251/111; 74/526; D8/349, 354; D15/9.1

(56) References Cited

U.S. PATENT DOCUMENTS

| | | | | |
|---|---|---|---|---|
| 4,095,629 | A | | 6/1978 | Jordan |
| 4,175,595 | A | * | 11/1979 | Noe |
| 4,200,128 | A | | 4/1980 | Pokrzywa |
| 4,200,943 | A | * | 5/1980 | Fredin et al. |
| 4,201,253 | A | | 5/1980 | Maloney |
| 4,210,181 | A | | 7/1980 | Clevenger |
| 4,245,682 | A | | 1/1981 | Agnew, Sr. |
| 4,275,776 | A | | 6/1981 | Rehkopf |
| 4,278,116 | A | | 7/1981 | Opp |
| 4,287,736 | A | | 9/1981 | Hadgis |
| 4,334,560 | A | | 6/1982 | Lockwood |
| 4,337,917 | A | | 7/1982 | Tesack et al. |
| 4,683,923 | A | | 8/1987 | Harris |
| 4,690,182 | A | | 9/1987 | Knaus |
| 4,722,375 | A | | 2/1988 | Fox |
| 4,846,442 | A | | 7/1989 | Hanna |
| 5,118,174 | A | | 6/1992 | Weissman |
| 5,517,732 | A | * | 5/1996 | Crear |
| 6,095,173 | A | | 8/2000 | Perry |
| 6,227,266 | B1 | | 5/2001 | Moore et al. |

* cited by examiner

*Primary Examiner*—Steven O. Douglas

(57) ABSTRACT

An improved interposer for lifting, supporting and maintaining the operating flow lever/trigger for all of the various gasoline or diesel pump hand inventive device comprises a single element support with two ends Each end of the invention provides variant concave attributes to address the nuances of the multitude of manufactured nozzle handles. While the invention is singular in nature, the design features also address stability during operation regardless of the invention's orientation. And finally, the invention provides for multiple storage options.

1 Claim, 4 Drawing Sheets

HANDS-FREE REFUELING TRIGGER STANCHION

FIELD OF THE INVENTION

The invention relates to a significantly improved, yet simplified device, for use in petroleum dispensing apparatuses. In particular, when the nozzle manufactured trigger-locking mechanism is missing or inoperable on the myriad of manufactured nozzle devices used in customer self-service stations. Using one hand, the invention provides the user to begin the refueling process and adjust the rate of fuel flow. Once the desired rate is obtained, the invention allows continuous lift force on the dispensing nozzle operating lever so that the gasoline/diesel tank may be filled without the immediate attendance by the individual. The design further provides for three different options of storage when not in use.

DESCRIPTION OF THE RELATED ART

The field of gasoline nozzle holders, control devices and latches is quite populated Drilling down on these inventions reveals a subset of approaches that clamp, clip, hang or wedge the operating lever. As evidenced in the research of the many patented holding devices for gasoline nozzles, it is clear that they all intentionally satisfy the primary function of providing some level of adjustability and maintenance of continuous petroleum flow.

The following prior arts of nozzle holding devices and relied Upon include: U.S. Pat. No. 6,227,266, Moore et al.; U.S. Pat. No. 6,095,173, Perry; U.S. Pat. No. 5,517,732, Creer; U.S. Pat. No. 5,118,174, Weissman; U.S. Pat. No. 4,846,447,Hanna; U. S. Pat. No. 4,722375, Fox; U.S. Pat. No. 4,690,182, Knaus; U.S. Pat. No. 4,683923, Harris; U.S. Pat. No. 4,337,917, Tesack et al.; U.S. Pat. No. 4,334,560, Lockwood; U.S. Pat. No. 4,287,736, Hadgis; U.S. Pat. No. 4,278,116, Opp; U.S. Pat. No. 4,275,776, Rehkopf; U.S. Pat. No. 4,245,682, Agnew Sr; U.S. Pat. No. 4,210,0181, Clevenger; U.S. Pat. No. 4,201,253, Maloney; U.S. Pat. No. 4,200,943, Fredin et al., U.S. Pat. No. 4,200,128, Pokrzywa; U.S. Pat. No. 4,175,595, Noe and U.S Pat. No. 4,095,629, Jordan.

Respective of the creativity and originality of the prior arts, the inventive device submitted for patent consideration contains all of the following attributes: a single mechanism, simplicity of operation, reversible to provide optimum surface relationships to the lower handle and operating flow lever, the ability for one-handed initiation of the re-fueling process, full range of adjustability of the flow rate, designed stability during operation, accessibility and storability.

U.S. Pat. No. 6.227,266 (Moore et al.) describes a spring compression system mechanism that generates constant lift to the operating flow lever.

U.S. Pat. No. 6,095,173 (Perry) describes a stem lift wedge mechanism with square ends to maintain the lever on gasoline pumps.

U.S. Pat. No. 5,517,732 (Crear) shows a clamping mechanism that utilizes a horizontal upper clamp arm, embracing the top of the nozzle assembly, attached to a vertical stanchion that intersects to a toggle ratchet lower clamp arm that is adjustable to maintain lift force to the operating lever.

U.S. Pat. No. 5,118,174 (Weissman) discloses a device that holds the lever of the gas pump at two operating level positions. The device hooks over the top of the handle and when suspended provides three 'fingers' for lever hold.

U.S. Pat No.4,846,447 (Hanna) describes an actuator device consisting of a pair of jaws in which the upper jaw fits over the housing while the other jaw fits under the trigger.

U.S. Pat. No. 4,722,375 (Fox) shows an octagonal shaped flat piece of plastic, wood, metal, rubber or other material formed to have four pairs of opposing side edge regions for wedging.

U.S. Pat. No. 4,690,182 (Knaus) depicts another 'C' type suspension device that hooks over the top of the handle and has two (2) stepped arms to actuate flow operations U.S. Pat No.4,683,923 (Harris) shows a clamp in the form of a clip with serrated rows of teeth along the inner edge of the clamp arms to accommodate various sized nozzle handles.

U.S. Pat. No 4,337,917 (Tesack et al.) shows a device that fits on a gasoline pump handle to hold the valve open with a collapsible brace.

U.S. Pat No. 4,334,560 (Lockwood) describes a portable brace with adjustable length for retaining the trigger lever of a fuel-dispensing nozzle in the open position.

U.S. Pat. No. 4,287,736 (Hadgis) depicts another clip approach to suspending the operating trigger of a gas pump to hold in an open position. The top of the clip goes on top of the gas pump handle and the bottom of the clip goes under the trigger.

U.S. Pat. No. 4,278,116 (Opp) displays a semi-trapezoid wedge device with multiple combinations of orientations and insertions within the handle assembly utilizing a myriad of combinations of shoulders and indentations.

U.S. Pat. No. 4,275,776 (Rehkopf) shows a holding device that is wedged into the front of the nozzle at the actuator side of the trigger lever.

U.S. Pat. No 4,245,682 (Agnew Sr.) depicts an offset shank device for the purpose of wedging the pump handle lever and scraping ice off the windshield. It is further designed to be stored on the sun visor.

U.S. Pat. No. 4,210,0181 (Clevenger) describes an adjustable prop mechanism that provides longitudinal movement fostered by an enclosed spring. A knurled knob is used to lock or loosen the shaft that actuates the operating lever of a pump nozzle. The magnet on the invention was to store on a metal gas cap.

U.S. Pat. No. 4,201,253 (Maloney) shows blocking device with numerous step level options that the user determines the orientation the specific platforms to use. The invention includes a magnet for mounting to a metal surface such as a dashboard.

U.S. Pat. No. 4,200,943 (Fredin et al.) portrays a single automobile tool that contains several applications: ice scraper, a detachable jam device to hold open the license plate fuel door and attached to the other end of the ice scraper is a wedge device with a plurality of steps to vary the flow of the gasoline.

U.S. Pat. No. 4,200,128 (Pokrzywa) portrays a fuel valve actuator hold open lock hat is comprised of a formed member that is inserted into the opening of a trigger guard a gasoline pump delivery valve assembly.

U.S. Pat. No. 4,175,595 (Noe) describes a gasoline flow control rectangular plate wedge that provides a single operating lever surface capable of providing four (4) flow rates using graduated contoured steps.

U.S. Pat. No. 4,095,629 (Jordan) shows removable clamp that hooks onto the rear of the nozzle unit (near the hose) and engages the free end of the operating lever.

SUMMARY OF THE INVENTION

The objective of this invention is to provide the means to initiate, adjust, facilitate, affirm and support the trigger flow lever of a fuel pump nozzle so that the dispensing equipment allows the continuous flow of petroleum into the fuel tank. Contiguous to functionality of the invention, the inventive device embodies unique usability, accessibility and storability characteristics.

To this point, the submission the inventive device has only been broadly outlined. In order to aid the examiner in the evaluation process and just as importantly, the general public to apprise and provide material assistance to understand and aid them in future patent searches. The foregoing documentation and provides a summary of the exact nature, purpose, operation and features of the invention, as well as differentiation from prior ant submissions.

The object of the present invention is to provide a single, uncomplicated mechanism to enable a user to refuel without constant attendance at the fuel-dispensing nozzle.

Another object of the present invention provides reversibility. The design provides at either end of the inventive device convex characteristics. Each end is designed intentionally different to address the variability of different manufactured nozzle handle configurations and underside convexity of the operating lever that are encountered. One convex end resides above a designed protrusion, referred to as channel legs, to interface with the lower handle channel. The determination of orientation is the function of the lower nozzle handle characteristic.

Another object of this invention gives the user the ability to use only one hand to begin to refuel. This is a function of the single stanchion design, concave characteristics and protrusion. Using one hand, the present invention is positioned diagonally within the handle frame. One end is inserted into or straddles the lower handle frame and the other end mates to the convex underside of the operating lever. Rotating the invention in either clock or counter clockwise direction, lifts the operating level, starting the flow of fuel.

Another object of the invention encompasses the adjustability feature Once the inventive device is rotated to begin fueling, continuing to rotate the entire stanchion increases the lift of the operating lever. Once the desired flow is achieved, the user may release and allow the inventive device to maintain constant flow of fuel. Rotation of the invention to perpendicular to the lower handle frame provides maximum flow rate.

Another object of the present invention provides for unique stability without requiring arms, springs or ratchets The stability is capitalized by utilizing the inherent propensity of the operating lever to return to the closed position and contoured operating lever coupled with the mating of the concave/protrusion design characteristics that surround the opposing lower handle and operating lever. Stability is further enforced when the inventive device's orientation allows the protrusion end to firmly inside the lower handle channel, the device provides surface contact with the upper rails of the handle's channel.

It is another object of the present invention is to capitalize on injection molding process, using an ABS plastic composite material, requiring only the necessary material according to stress, stability, reversibility design objectives and storage requirements. The invention's dimensions are: H 2⅞×W 1 ⅜×D 3⁄16 at the largest points and has a weight of only 2 grams.

Yet another object of the invention is to provide a plurality of readily accessible storage options. The most unique storage option is the proviso of, on one side at center of stem of inventive device, a coverage area that provides a myriad of miniature hooked fingers to facilitate connection to the soft Velcro ™ side that is adhered to the inside of the fuel door when not in use. A channel existing laterally throughout the center of the invention facilitates another storage option. The channel allows for the insertion of a key stein resembling a sheath. This option allows for a quick disconnect of the key from the inventive device to protect keys from theft during unattended operation. Of course, similar to previous arts, an eyelet is provided if the user is so compelled to store the invention on their key ring.

Finally, the object of the inventive device is to yield a single element stanchion with all of the designed objects of invention and attributes to yield an extremely low cost of manufacture, which is passed eventually as a component of the price to the consumer.

DETAILED DESCRIPTION OF THE INVENTION

In deference to the drawings FIGS. 1–9, they illustrate the present invention embodying the features, operational aspects, concepts and orientations. For purposes of illustration the Hands-Free Refieling Trigger Stanchion will be referred to with the Arabic numeral 10.

Figure 1:
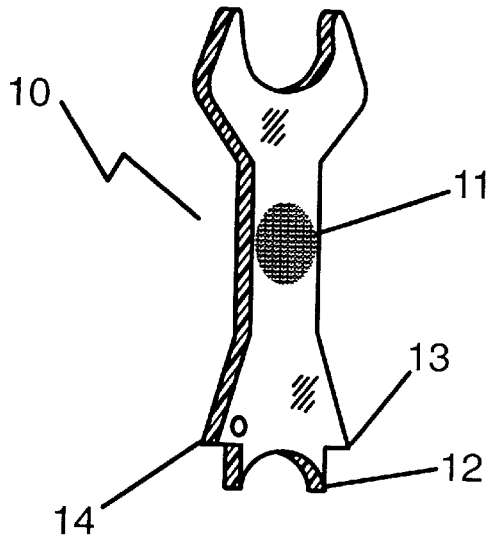
FIG. 1 is an isometric illustration the Hands-free Refueling Trigger Stanchion.

In FIG. 1, 10, represents the illustration of the Hands-Free Refueling Trigger Stanchion in the primary orientation. At the center of the stem of the invention, the array of a coverage area includes a myriad of miniature plastic hooked fingers 11. When mated with a soft side of a Velcro™ spread, 11 will provide adherence for storage, to be described at detail in a later drawing. When, in the primary orientation, the channel leg(s) 12 enforces stability and registration of the present invention when inserted into the nozzle's lower handle channel. Stability is further enhanced by the channel wings 13 that provide spans on both sides to the lower handle upper rails, thereby eliminating any lower lateral shifting of the invention during operation. The eyelet 14 is located between the channel leg and span on one side of the invention.

Figure 2:
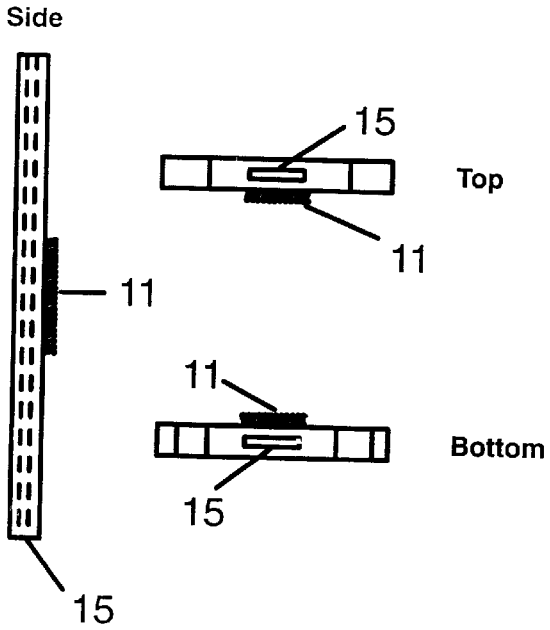
FIG. 2 is a side, top and bottom view thereof.

Shown in FIG. 2, the top, bottom and side view of the Hands-Free Refueling Trigger Stanchion is depicted. A hollow channel 15 runs throughout the entire length of the present invention. The array of miniature hooked fingers 11 is also shown for reference.

Figure 3:
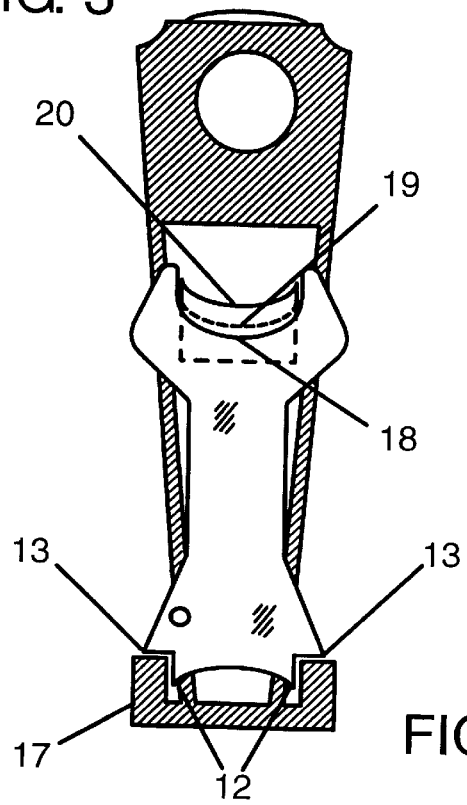
FIG. 3 is a rear view of a nozzle handle with an illustrative view of present invention engaged.

FIG. 3 represents a direct rear end view of the dispensing nozzle with the invention 10 in its primary orientation during operation. At the lower end of the invention, the invention's design enforces lower end stability and registration of the support mechanism by the channel legs 12 protruding into the channel of the lower handle 17 of the dispensing nozzle. Stability is further enhanced by the channel wings 13 that provides a footing on both sides to the lower handle's upper rails, thereby eliminating any lower lateral shifting of the invention during operation. The opposite end of the invention 18 is concaved to accept the convex design of the nozzle's lower surface 19 of the operating flow lever 20.

Figure 4:
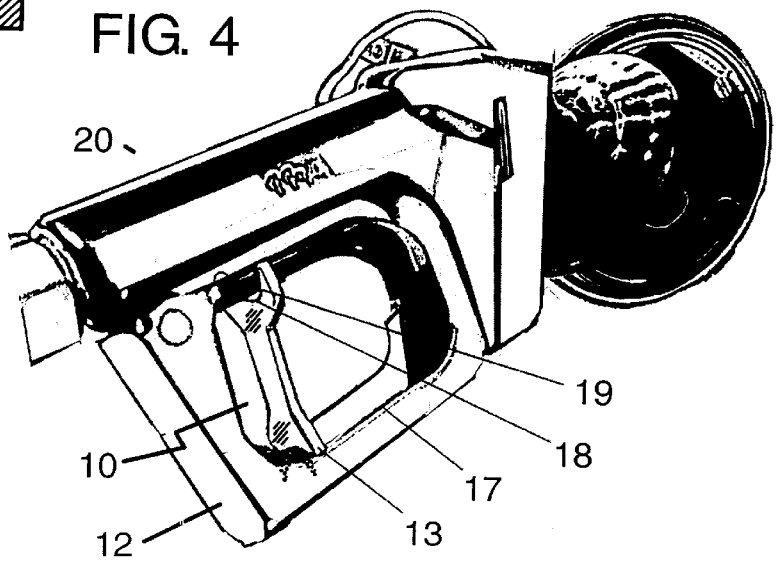
FIG.4 is a perspective view of the present invention being utilized with a gasoline pump handle.

FIG. 4 provides a side angle view illustrating the invention in its primary orientation in the 'engaged' position. This view shows the invention 10 essentially perpendicular to the lower handle and the flow-operating trigger. With the channel legs 12 seated within the confines of the lower handle channels 17 and channel wings 13 provides stability. This stability is further enhanced by the matching concave groove 18 of the invention, also known as the cradle, to the convex shape 19 of the lower side of flow operating lever 20. This stability is especially required when the auto shut-off feature of the pump handle has been activated to assure the invention remains within the handle.

Figure 5:
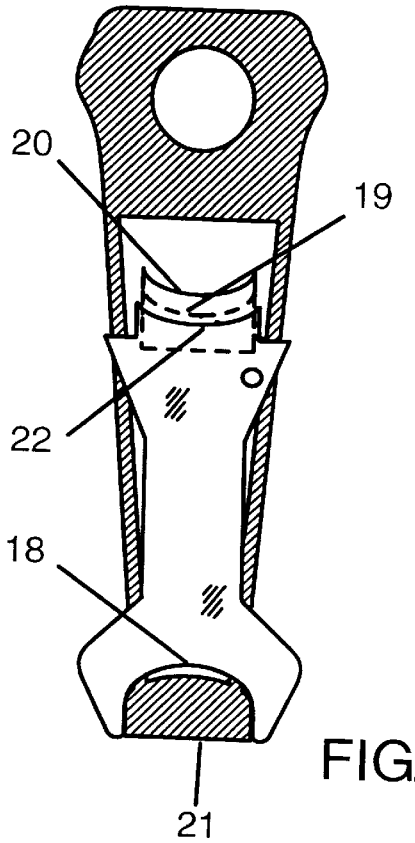
FIG. 5 is a rear view of different nozzle handle with an illustrative view of present invention engaged.

FIG. 5 provides a direct rear end depiction of the back end of another style pump handle with the invention 10 in an inverted position, which is also known as the secondary orientation. In this configuration since the lower handle 21 does not have the channeling feature, the lower end concave property 18 of the invention straddles the lower handle's width. The opposite end of the invention is concaved 22 to accept the convex surface of the nozzle's lower surface 19 of the operating flow lever 20.

Figure 6:
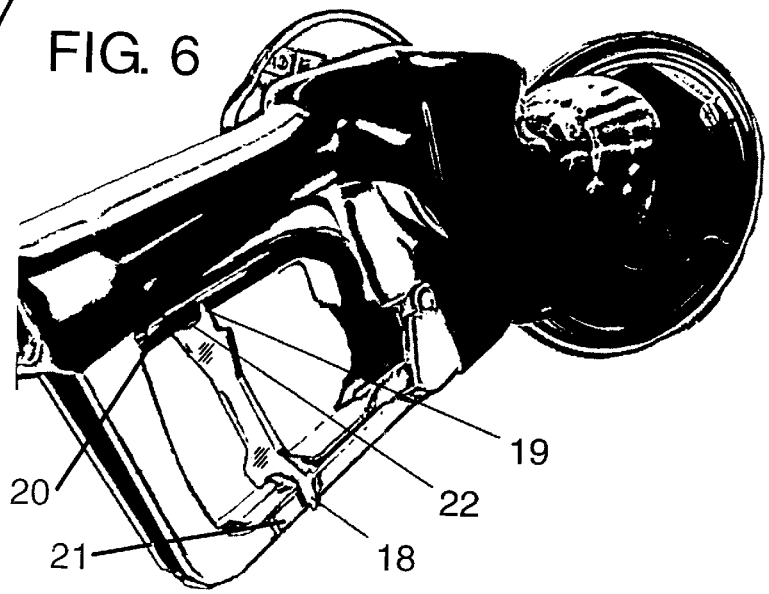
FIG. 6 is a perspective view of the present invention being utilized with a different gasoline pump handle.

FIG. 6 provides a side angle view illustrating the invention in its secondary orientation in the engaged position. This view shows the invention essentially perpendicular to the lower handle 21 and the flow-operating lever 20. Since the style of pump nozzle does not have a lower handle channel as described above in FIG. 4, the lower end concave feature or cradle 18 of the invention straddles the lower pump handle 21. The upper concave cradle 22 fits convex surface of the nozzle's lower surface 19 of the operating flow lever 20. The straddling factor coupled with the concave/convex match-up provides more than adequate stability during operation. This stability is assures that when the auto shut-off feature of the pump handle has been activated the invention remains within the handle.

Figure 7:
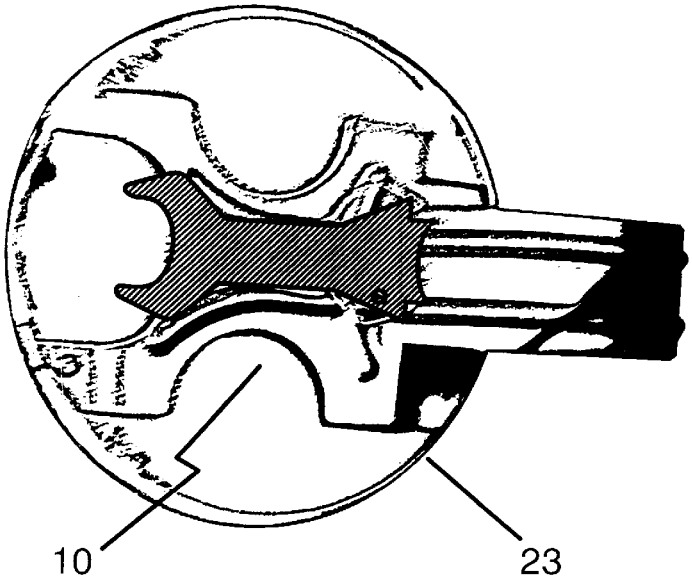
FIG. 7 is a depiction of recommended storage location for the present invention inside the fuel door.

FIG. 7 represents the invention in its recommended storage position. The invention 10 can be stored inside the access door 23 of the fuel tank. Since many of the current automobiles use non-metallic materials for the access door, on one side of the invention at center of stem, provides a coverage area with a myriad of miniature hooked fingers 11. On the inside of the fuel tank door, the adhesive side of a soft Velcro™ patch is attached. The invention's miniature hooked fingers is pressed onto the soft Velcro™ patch for storage.

Figure 8:
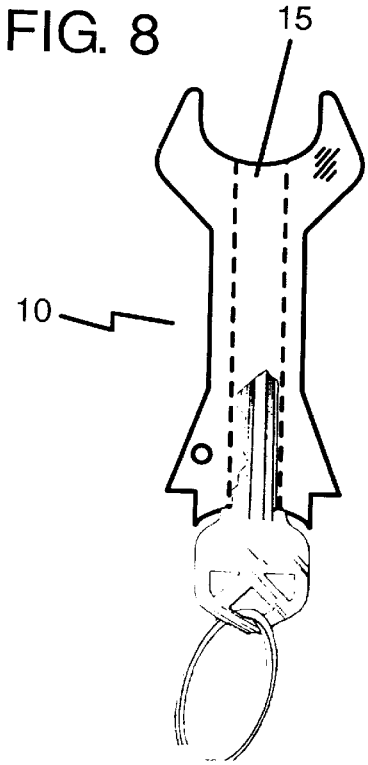
FIG. 8 is a depiction of another storage capability of present invention by inserting a key through the center of the invention.

FIG. 8 embodies another storage capability of the invention. A hollow channel 15 existing vertically within the center of the invention 10 provides a cavity for insertion of an object Ideally, a rarely used key on the users key ring can be heated and inserted into the channel. Once cooled, the channel forms to the inserted object. The primary reason for this storage option is so that the auto keys can be separated from the invention during the refueling process especially if left unattended.

Figure 9:
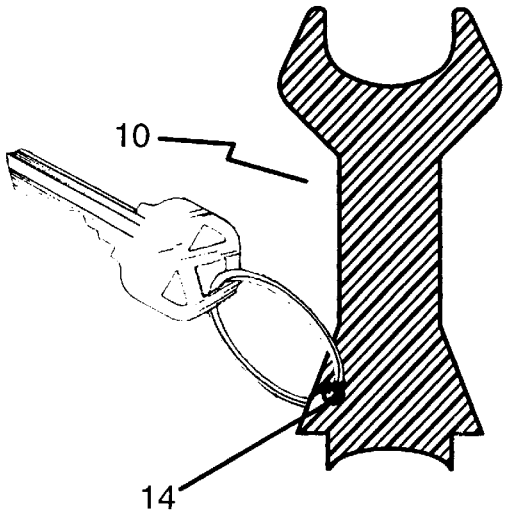
FIG. 9 depicts yet another storage option that utilizes the eyelet hole in the invention that can be attached to a key ring.

FIG. 9 shows an additional storage option of the invention 10, wherein a key ring containing the ignition key is inserted into the eyelet hole 14 of the invention. This assures that the invention is immediately available when traveling.

What is claimed is:

1. A fuel nozzle actuation device for use with a fuel nozzle with an associated flow operating lever and lower pump handle comprising:

a stanchion being arranged for one-handed manipulation by a user and having a first and second end adapted to be disposed between the lower pump handle and the flow operating lever, and a plurality of storage alternatives integrated with said stanchion, wherein the plurality of storage alternatives includes a cluster of hooked fingers arranged on the stanchion for adherence to a loop portion of a Velcro™ fastener strip to be disposed on an inside surface of a fuel access door, a channel running laterally through the stanchion for insertion of a key, and an eyelet for insertion of a key ring.

* * * * *